US010767372B1

(12) United States Patent
Hansen

(10) Patent No.: US 10,767,372 B1
(45) Date of Patent: Sep. 8, 2020

(54) FASCIA MOUNTED RAILING SYSTEM

(71) Applicant: Tracy C. Hansen, Hillsboro, OR (US)

(72) Inventor: Tracy C. Hansen, Hillsboro, OR (US)

(73) Assignee: C.R. LAURENCE CO., INC., Los Angeles, CA (US)

( * ) Notice: Subject to any disclaimer, the term of this patent is extended or adjusted under 35 U.S.C. 154(b) by 462 days.

(21) Appl. No.: 15/718,517

(22) Filed: Sep. 28, 2017

(51) Int. Cl.
*E04F 11/18* (2006.01)

(52) U.S. Cl.
CPC ..... *E04F 11/1812* (2013.01); *E04F 11/1802* (2013.01); *E04F 11/1817* (2013.01); *E04F 11/1853* (2013.01); *E04F 2011/1831* (2013.01)

(58) Field of Classification Search
CPC .. E04H 17/16; E04F 11/1851; E04F 11/1853; E04F 11/1812; E04F 2011/1831; E04F 2011/1823
See application file for complete search history.

(56) References Cited

U.S. PATENT DOCUMENTS 4,390,165 A * 6/1983 Murdock ..... E04F 11/1851 256/19
4,905,970 A * 3/1990 Holmsten ..... A63C 19/10 256/24
5,771,646 A * 6/1998 Desouza ..... E04F 11/1812 248/300
6,269,600 B1 * 8/2001 Tambakakis ..... E04B 2/885 52/235
6,349,517 B1 * 2/2002 Manley ..... E04B 2/7435 160/135
6,804,920 B2 * 10/2004 Hogan ..... E04B 2/96 52/204.5
6,964,410 B1 * 11/2005 Hansen ..... E04F 11/1812 256/24
7,434,790 B1 * 10/2008 Hansen ..... E04F 11/1851 256/19
7,497,057 B1 * 3/2009 Hansen ..... E04F 11/1853 52/578
7,559,536 B1 * 7/2009 Hansen ..... E04F 11/1851 256/25
7,866,636 B1 * 1/2011 Hansen ..... E04F 11/1836 256/65.14

(Continued)

FOREIGN PATENT DOCUMENTS

CN 204 899 076 U 12/2015
EP 2 982 870 A1 2/2016

OTHER PUBLICATIONS

EUIPO, European Search Report dated Feb. 22, 2019 regarding Application No. 18197059.1-1002, 8 pages.

*Primary Examiner* — Daniel J Wiley
(74) *Attorney, Agent, or Firm* — Cislo & Thomas, LLP

(57) ABSTRACT

A fascia mounted railing system that uses brackets that secure the posts to the slab while also providing base support for the infill panels without the use of a base rail. It does this by using a bracket to secure the posts and a second bracket that fits within the bottom of the post. This bracket has end flanges that extend outwardly from the post to support an infill panel. The infill panels can have a base treatment to conceal the face of the slab, if desired, for a more aesthetically pleasing appearance. In addition, the system has the capacity for a top railing that can be attached to the back of the posts as a grab rail, or attached to the top of the posts (with a bracket) for a top rail.

12 Claims, 15 Drawing Sheets

(56) References Cited

U.S. PATENT DOCUMENTS

| | | | | |
|---|---|---|---|---|
| 9,097,025 | B2 * | 8/2015 | Procter | E04F 11/1851 |
| 9,453,357 | B1 * | 9/2016 | Bertato | E04H 17/16 |
| 2001/0025953 | A1 * | 10/2001 | Shepherd | E04F 11/1851<br>256/24 |

* cited by examiner

FASCIA MOUNTED RAILING SYSTEM

CROSS REFERENCE TO RELATED APPLICATIONS

Not Applicable

STATEMENT REGARDING FEDERALLY SPONSORED RESEARCH AND DEVELOPMENT

Not Applicable

BACKGROUND OF THE INVENTION

1. Field of the Invention

This invention relates to fascia mounted railing systems and particularly to fascia mounted railing systems having slab-mounted base of post supports.

2. Description of the Prior Art

Modern building design for high-rise apartments and other types of building structures often have concrete balconies. These balconies allow the residents to enjoy outdoor space attached to their dwelling units or offices. For safety purposes, these balconies have railing systems installed. Typically, these guardrails are fabricated from metal or concrete. Guardrails fabricated using metal are usually either surface mounted to the top of the slab using a base plate, or mounted into a core pocket. Although these designs work and provide the necessary protection, they are not the most aesthetically pleasing constructions.

Over the years I have developed several different designs for railing systems. Two of these enable a railing system to be mounted to the face of a slab. These designs are found in U.S. Pat. Nos. 7,497,057; and 7,617,650. Two problems exist in mounting a rail to the face of a slab: one is in how to support the railing posts against the slab and the other is how to support infill panels when the railing posts are mounted in front of a slab. Both designs solve this problem by using a number of fascia brackets to secure posts to the outer face of the elevated slab balcony. The posts have a base track secured to them to support the infill panels, which are then placed between the posts to provide the wall structure. A top rail can be used to cover the top of the infill panel. Note that both designs secure the posts to the slab at a point above the base of the posts. As noted above, a base track is installed as well.

BRIEF DESCRIPTION OF THE INVENTION

The instant invention is a design for fascia mounted railings that uses brackets that secure the posts to the slab while also providing base support for the infill panels without the use of a full base rail. It does this by using a first bracket to secure the posts to the slab and a second bracket that fits within the bottom of the post to support the infill panels. This bracket has end flanges that extend outwardly from the post to support an infill panel. Note the infill panels can have a base treatment to conceal the face of the slab, if desired, for a more aesthetically pleasing appearance. In addition, the system has the capacity for a top railing that can be attached to the back of the posts as a grab rail, or attached to the top of the posts (with a bracket) for a top rail.

DETAILED DESCRIPTION OF THE INVENTION

Figure 1:
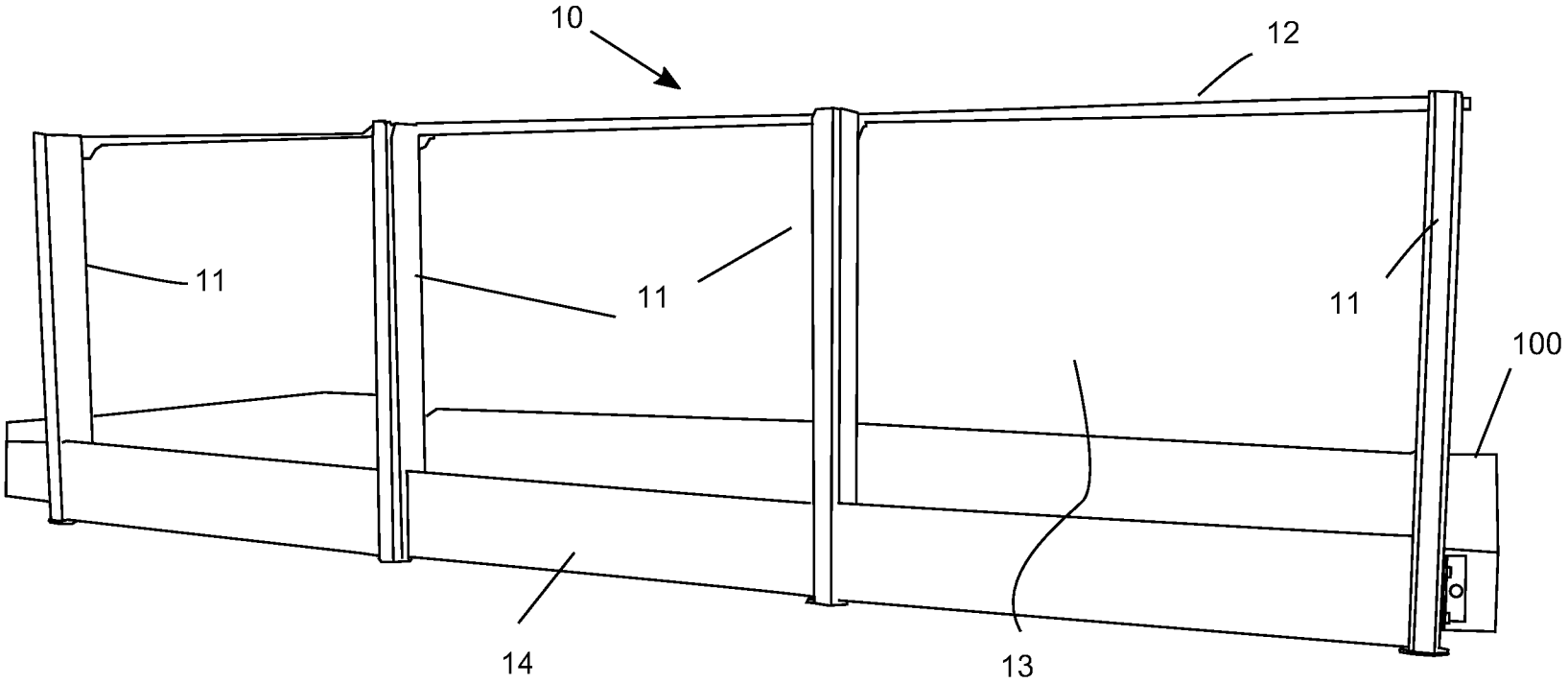
FIG. 1 is a perspective view of the first embodiment of my new railing, attached to a slab.

Referring now to FIG. 1, a perspective view of the first embodiment 10 of my new railing attached to a slab 100 is shown. In this view, the posts 11 are shown along with the back rail 12, and infill panels 13. The infill panels 13 have masking 14, such as a ceramic frit pattern, to hide the face of the slab. Note that there is no base rail used in this design. As discussed below, the infill panels are supported by brackets attached to the bottom of the posts 11.

Figure 2:
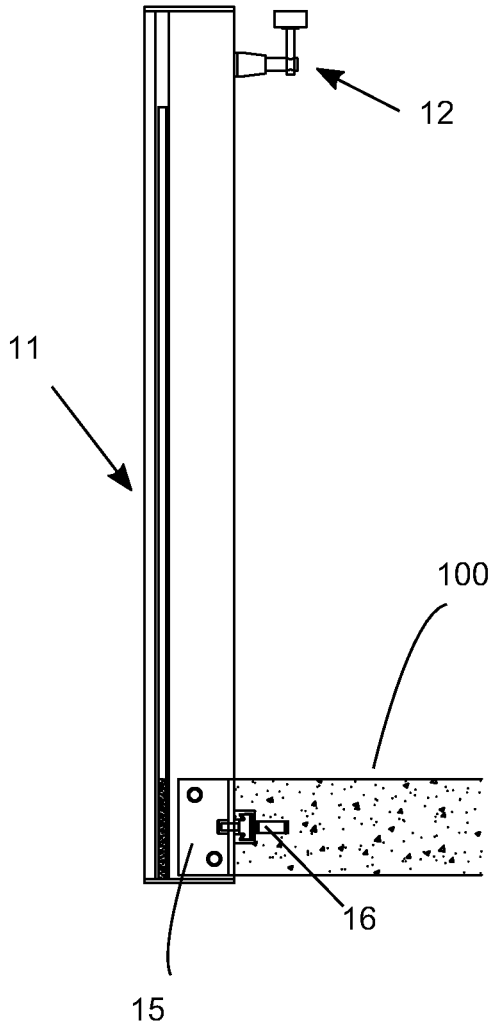
FIG. 2 is a right side detail view of a post, installed on a slab showing the first embodiment.

FIG. 2 is a right side detail view of a post 11, installed on a slab 100 showing the first embodiment. In the first embodiment a back mounted grab rail 12 is shown. Details of this rail are discussed below. This view shows the slab edge-mount brackets 15 and the fastener system 16 that attach the post to the slab.

Figure 3:
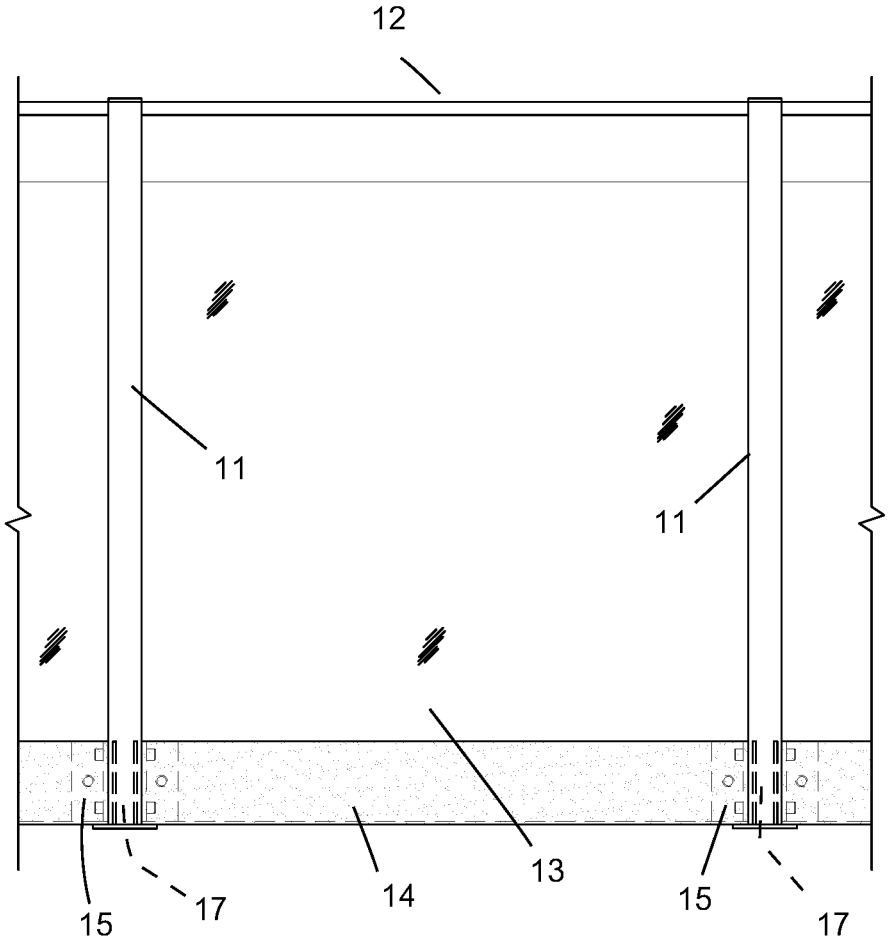
FIG. 3 is a front view of a portion of the railing, installed on a slab, showing the first embodiment.

FIG. 3 is a front view of a portion of the railing, installed on a slab, showing the first embodiment. In this view, the posts 11 and the infill panels 13 are shown. Also shown are the the slab edge-mount brackets 15 and the bottom brackets 17 that are attached to the posts and provide support for the infill panels, as discussed below.

Figure 4:
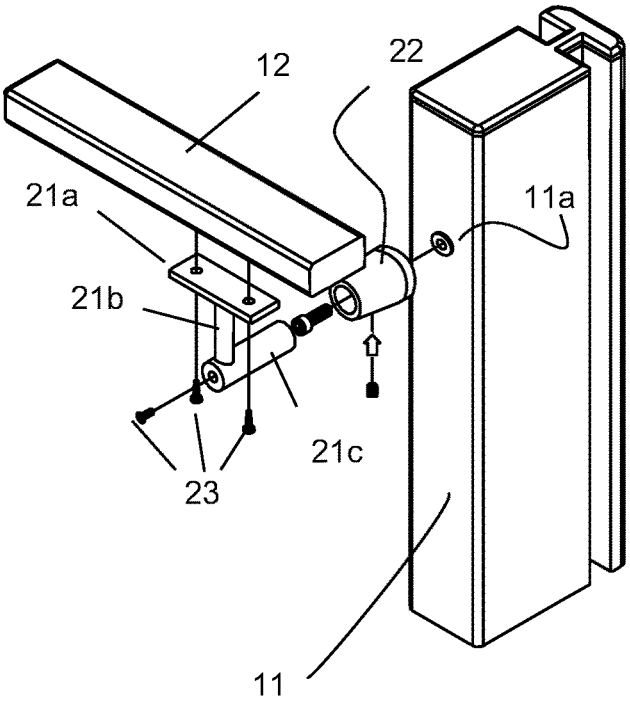
FIG. 4 is a rear exploded view of a post showing the attachment of the grab rail assembly of the first embodiment.

FIG. 4 is a rear exploded view of a post 11 showing the attachment of the grab rail assembly 12 of the first embodiment. The grab rail assembly 12 consists of a rail portion 20, a mounting bracket 21 and a post mounting spacer 22. The mounting bracket 21 has a top mount 21*a* that secures the bracket to the rail 20 with screws 23. The mounting bracket 21 also has a spacer 21*b* that extends downward to a mounting cylinder 21*c*. The mounting cylinder 21*c* passes through the mounting spacer 22 and is secured to the post with a fastener 23. Note that the post has a mounting hole 11*a* provided to attach the installation of two infill panels.

Figure 5:
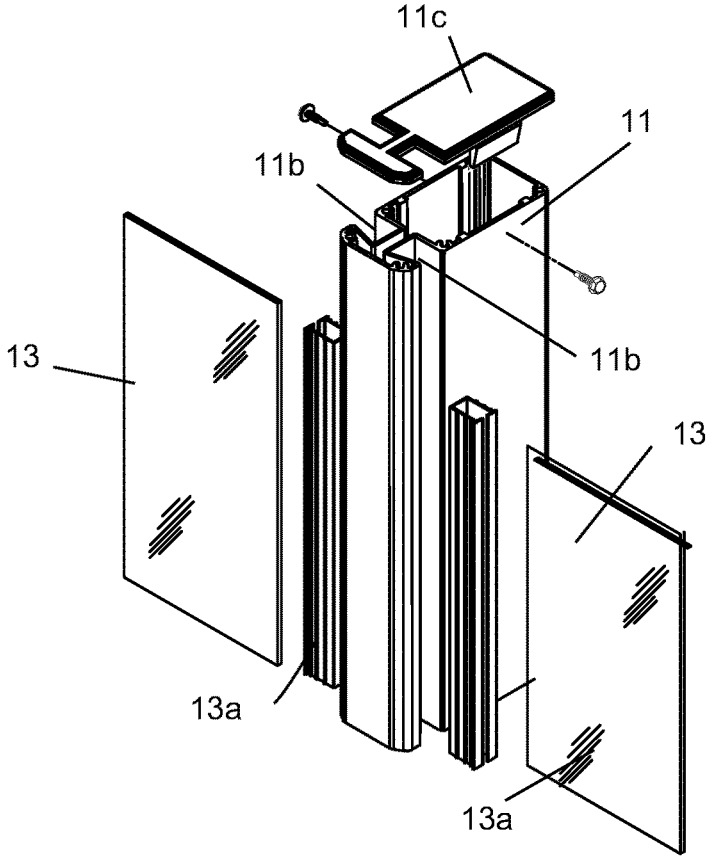
FIG. 5 is a front exploded view of post showing the installation of two infill panels.

FIG. 5 is a front exploded view of a post 11 showing the installation of two infill panels 13. Here the post 11 is shown. Note that the front of the post has a pair of formed channels 11*b* that receive the infill panels 13. A vinyl insert 13*a* is fit over the ends of each infill panel. The vinyl inserts and glass panels are fitted into the channels 11*b* on the post. Note, this view also shows a top cap 11*c* that is used in this first embodiment.

Figure 6:
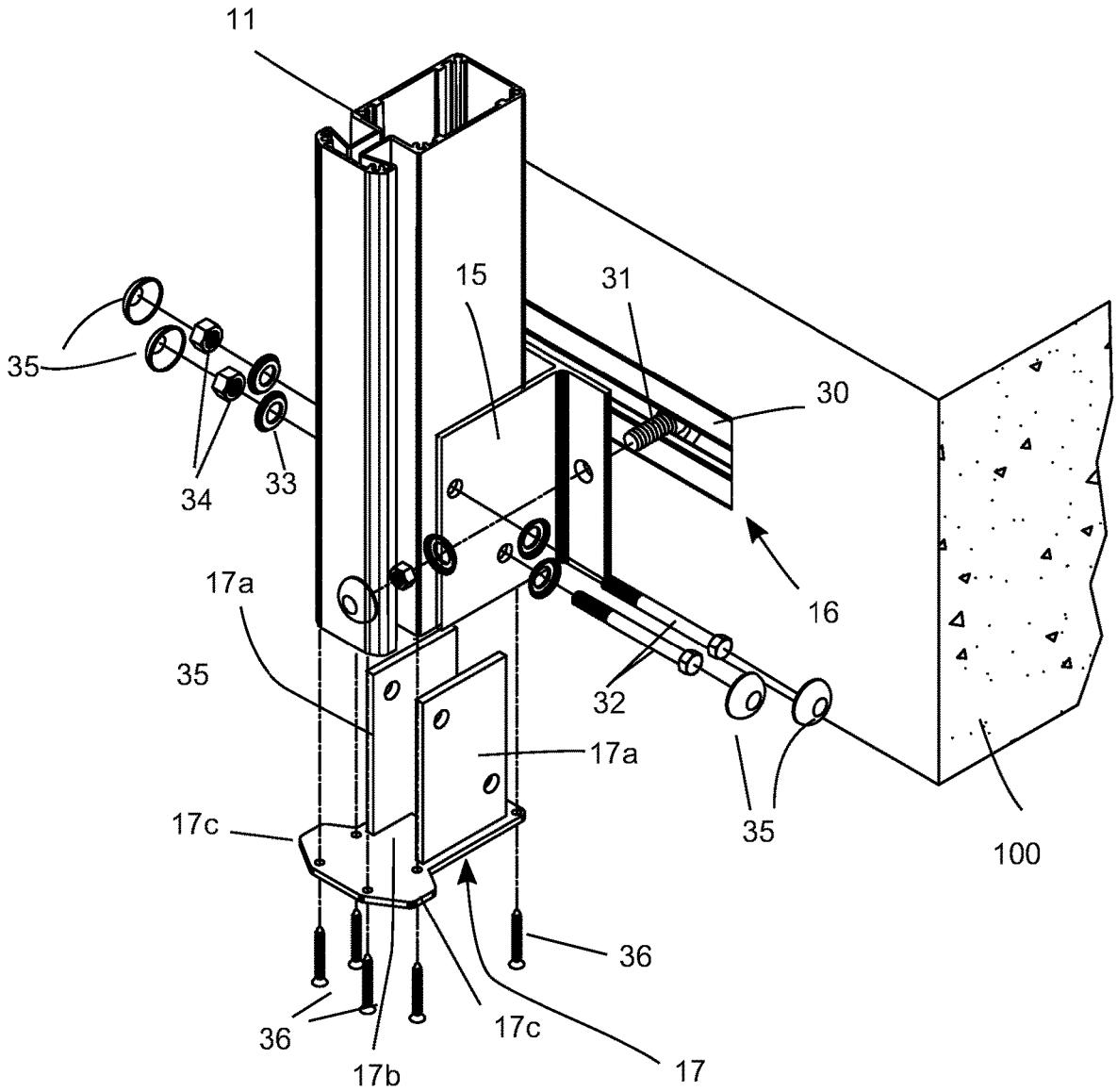
FIG. 6 is a front exploded view of a post bottom showing the assembly of the slab brackets and the base bracket.

FIG. 6 is a front exploded view of a post bottom showing the assembly of the slab brackets and the base bracket. Each post 11 is secured to the face of the slab 100 using a mounting system 16. This system includes a track 30 that holds bolts 31 so that they extend forward from the face of the slab as shown. A slab edge-mount bracket 15 is used to secure the post to the bolts 31. Each slab edge-mount bracket 15 is secured to a post using bolts 32, washers 33, nuts 34 and caps 35. Once secured to the post, the slab edge-mount bracket 15 is placed over the bolts 31 (there are two, one on each side of the slab edge-mount bracket 15) and are secured with washers 33, nuts 34 and caps 35.

This figure also shows the bottom bracket 17. This bracket has two vertical portions 17*a* that fit into the bottom of the post 11. These are secured to the post using the same bolts and hardware that are used to secure the slab edge-mount bracket 15. Note that the bottom bracket 17 also has a base 17*b* that has a formed front with ledges 17*c*. These ledges are used to support the glass infill panels, thus eliminating the need for a bottom rail that runs between the posts. Note too, that screws 36 are also used to secure the bottom bracket 17 to the post 11.

Figure 7:
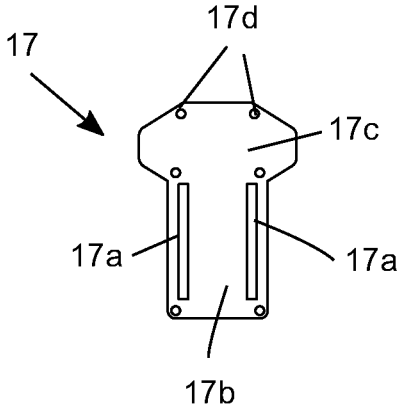
FIG. 7 is a top detail view of a base plate.

FIG. 7 is a top detail view of a bottom bracket 17 is shown. Note the vertical portions 17*a* and the base 17*b* that has a formed front with ledges 17*c*; note too, the screw holes 17*d* that hold the screws 36.

Figure 8:
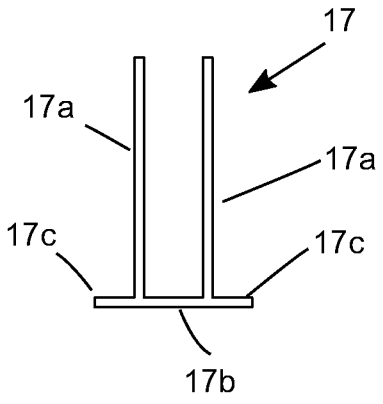
FIG. 8 is a front view of a base plate.

FIG. 8 is a front view of the bottom bracket 17. Here, the vertical portions 17*a* and the base 17*b* are shown.

Figure 9:
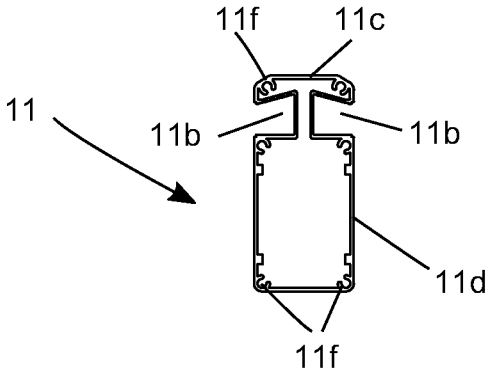
FIG. 9 is a detail view of a post extrusion.

FIG. 9 is a detail view of a post extrusion. There is a rectangular portion 11*d* and a face portion 11*e* with the spaces between them forming the channels 11*b*. Note the screw holes 11*f* that hold the screws 36 that help hold the bottom bracket to the post.

Figure 10:
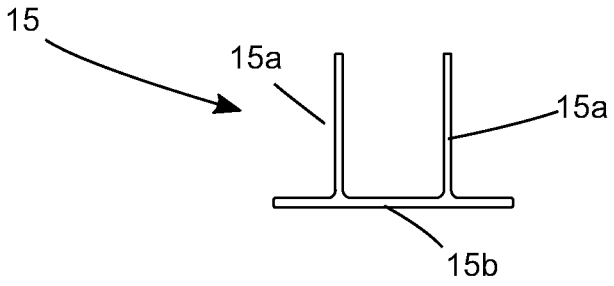
FIG. 10 is a top view of a slab edge-mount bracket.

FIG. 10 is a top view of a slab edge-mount bracket 15. The slab edge-mount bracket has two front arms 15*a* that fit around the post 11 and a base plate 15*b* that is secured to the slab face, as discussed above.

Figure 11:
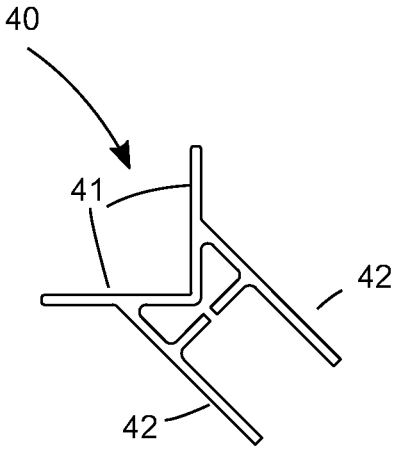
FIG. 11 is a top view of a corner fascia bracket.

The system also provides brackets for fitting around corners. FIG. 11 is a top view of a corner fascia bracket 40. This bracket has a 90° angle plate 41 and a pair of arms 42 that extend out from the 90° angle plate 41. These arms secure a post to the corner fascia bracket 40, as in the manner discussed above for a straight post section. Note that the corner fascia bracket 40 is attached to the slab with bolts through the 90° angle plate 41, also as discussed above.

Figure 12:
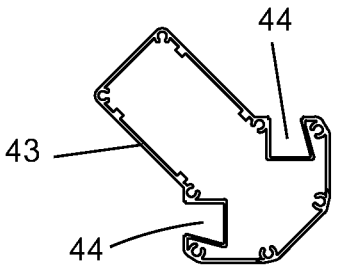
FIG. 12 is a top detail view of a corner post extrusion.

FIG. 12 is a top detail view of a corner post extrusion 43. Here, the main difference is that the channels 44 that receive the infill panels 13 are set at an angle, so that they form a right angle corner. Each of the infill panels placed in a corner post 40 extend to meet regular posts 11.

Figure 13:
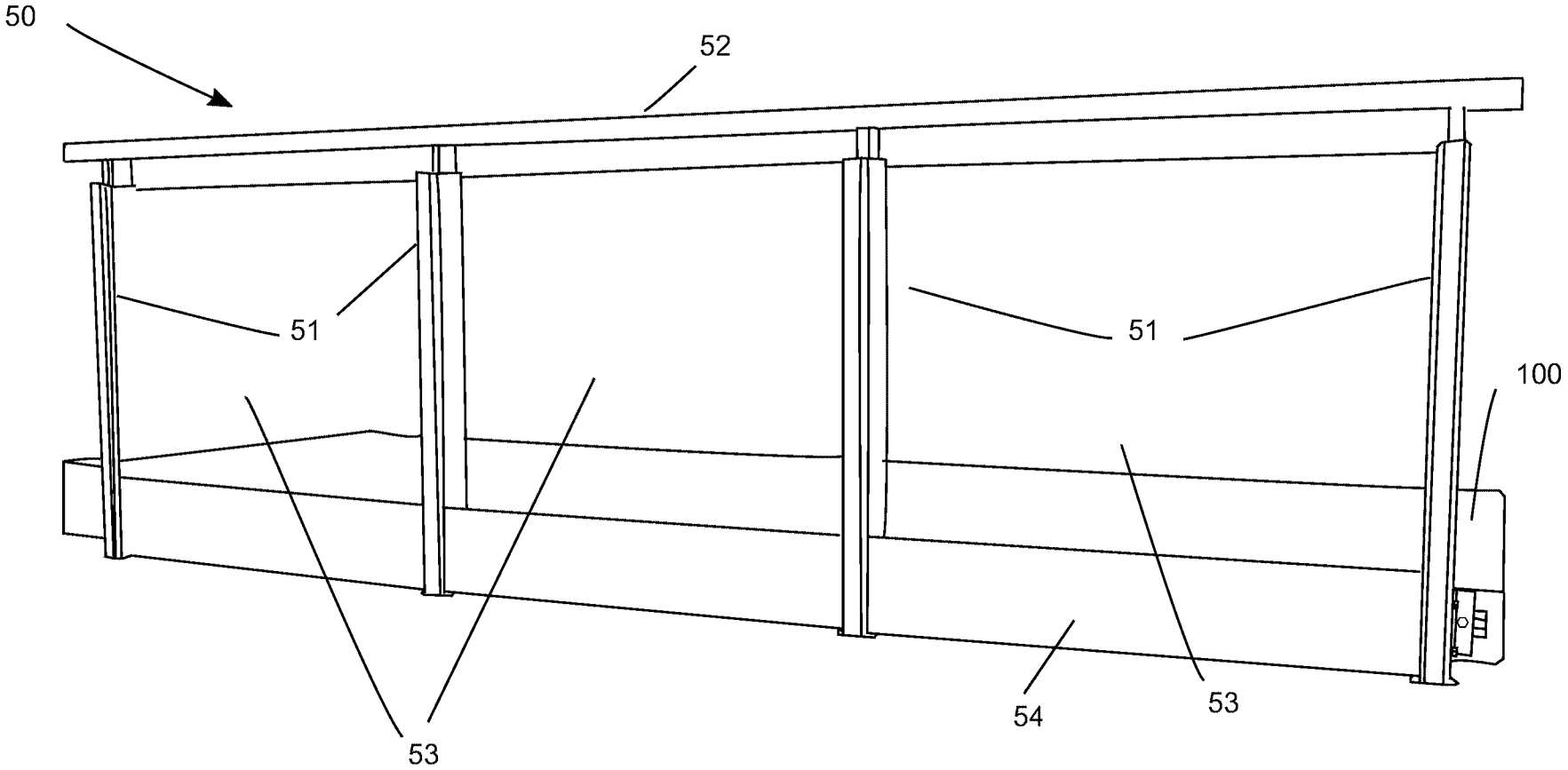
FIG. 13 is a perspective view of the second embodiment of my new railing.

FIG. 13 is a perspective view of the second embodiment 50 of my new railing. This embodiment is identical to the first embodiment except for the type of grab rail. In the first embodiment, the grab rail is attached to the back of the posts. In the second embodiment, the grab rail is attached to the top of the posts. This necessitates a different top structure for the posts. As shown in FIG. 13, the railing 50 has the elements as the first embodiment: posts 51 are shown along with the top rail 52, and infill panels 53 all attached to a slab 100. The infill panels 53 can have masking 54, such as a ceramic frit pattern, to hide the face of the slab. Note, as in the case of the first embodiment, there is no base rail used in this design. As discussed below, the infill panels are supported by brackets attached to the bottom of the posts 51.

Figure 14:
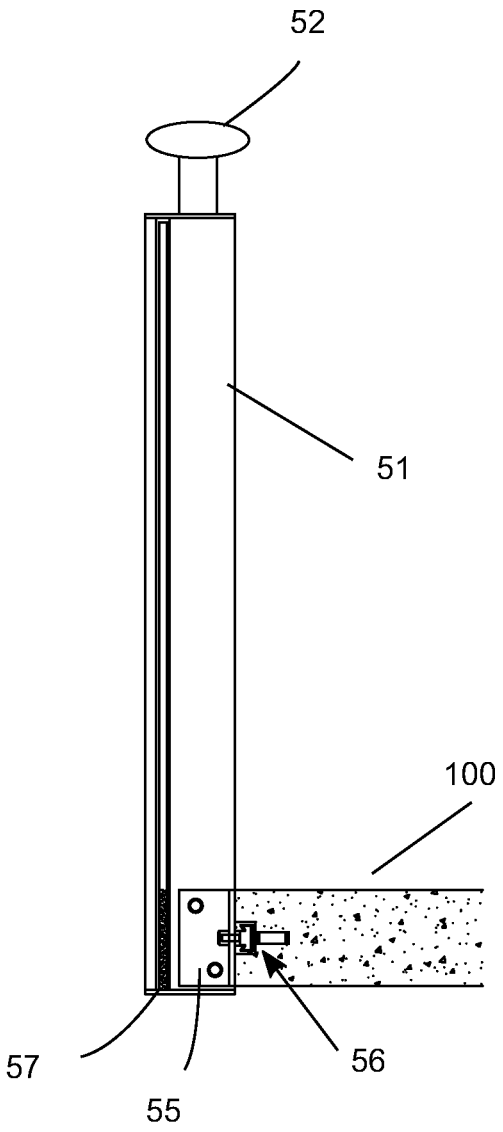
FIG. 14 is a right side detail view of a post, installed on a slab, showing the second embodiment.

FIG. 14 is a right side detail view of a post, installed on a slab, showing the second embodiment. Here, a post 51, installed on a slab 100 is shown. In the first embodiment a back mounted grab rail 12 is used (see e. g., FIG. 2). In this embodiment, a top rail 52 is used. Details of this rail are discussed below. This view shows the slab edge-mount brackets 55 and the fastener system 56 that attach the post to the slab.

Figure 15:
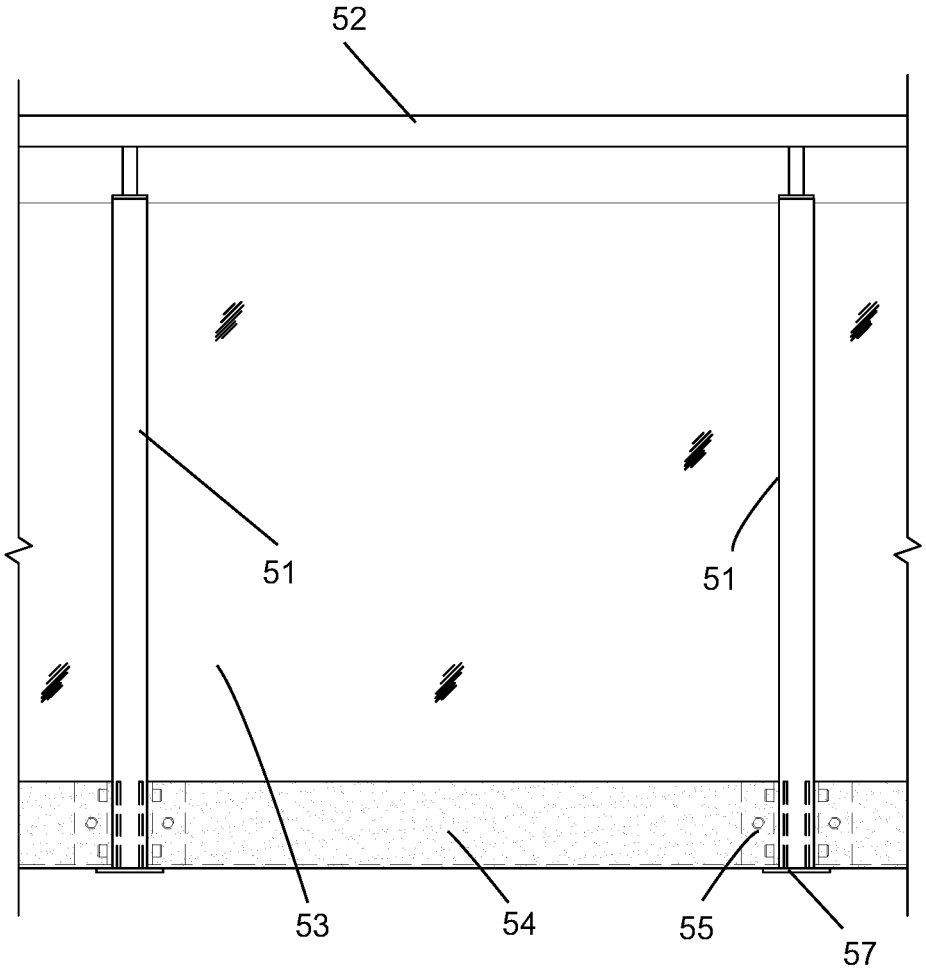
FIG. 15 is a front view of a portion of the railing, installed on a slab, showing the second embodiment.

FIG. 15 is a front view of a portion of the railing, installed on a slab, showing the second embodiment. In this view, posts 51 and the infill panels 53 are shown. Also shown are the the slab edge-mount brackets 55 and the bottom brackets 57 that are attached to the posts and provide support for the infill panels, as discussed below.

Figure 16:
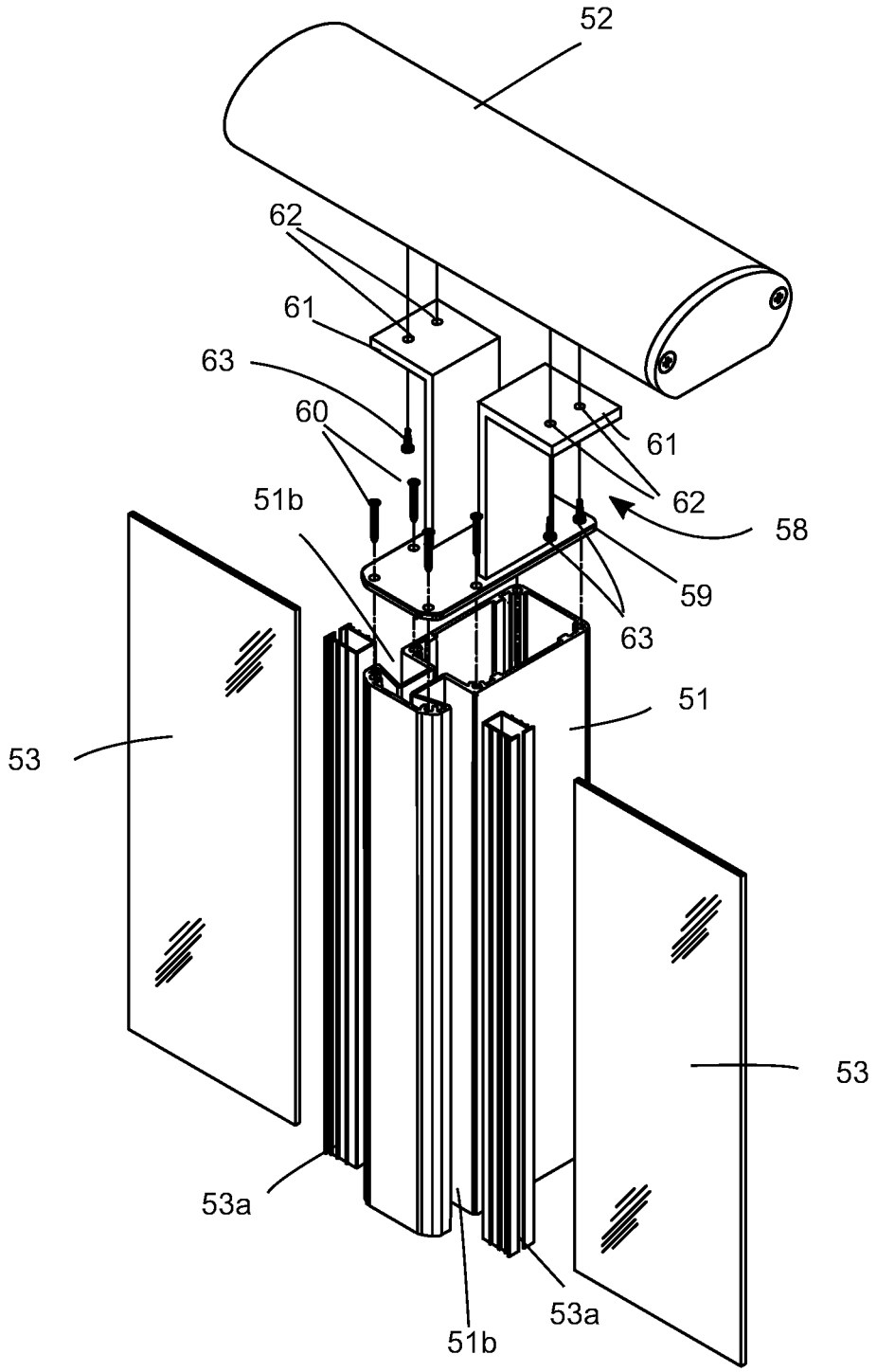
FIG. 16 is a rear exploded view of a post showing the attachment of the top rail assembly of the second embodiment.

FIG. 16 is a rear exploded view of a post showing the attachment of the top rail assembly of the second embodiment. Here, the post 51 is shown with the infill panels 53 and vinyl insert 53*a* is fit over the ends of each infill panel. The vinyl inserts and glass panels are fitted into the channels 51*b* on the post. Note, this view also shows the top cap for the post and the rail of the second embodiment. The top cap 58 has a base plate 59 that is fastened to the top of the post using fasteners 60. A pair of angle brackets 61 extends upwards from the baseplate 59 as shown. The tops of the angle brackets lie in the horizontal plane and are fitted with holes 62 for fasteners 63 that are used to fasten the top rail 52 to the angle brackets 61.

Figure 17:
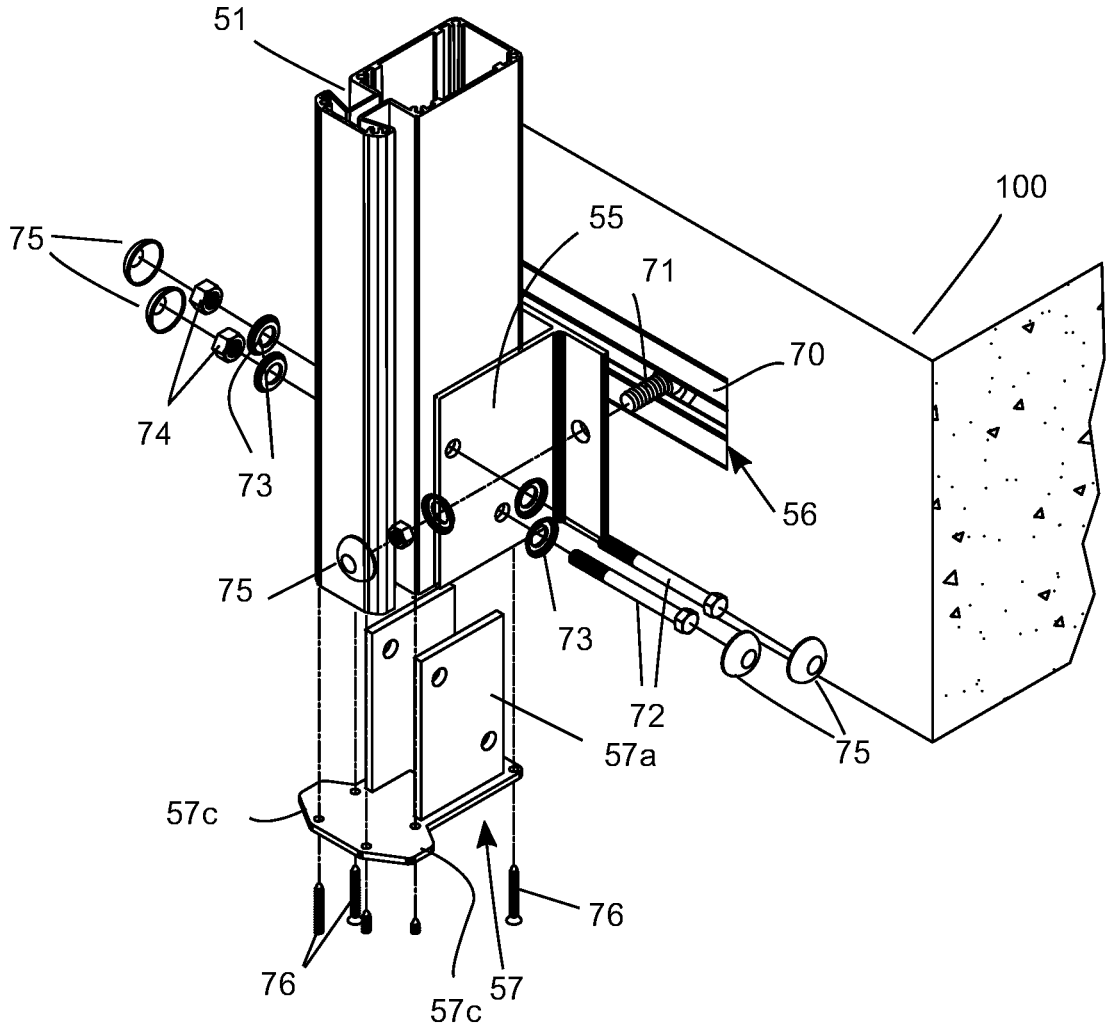
FIG. 17 is a front exploded view of a post bottom showing the assembly of the slab brackets and the base bracket of the second embodiment.

FIG. 17 is a front exploded view of a post bottom showing the assembly of the slab brackets and the bottom bracket. Each post 51 is secured to the face of the slab 100 using a mounting system 56. This system includes a track 70 that holds bolts 71 so that they extend forward from the face of the slab as shown. A slab edge-mount bracket 55 is used to secure the post to the bolts 71. Each slab edge-mount bracket 55 is secured to a post using bolts 72, washers 73, nuts 74 and caps 75. once secured to the post, the slab edge-mount bracket 75 is placed over the bolts 71 (there are two, one on each side of the slab edge-mount bracket 75 for each post) and are secured with washers 73, nuts 74 and caps 75.

This figure also shows the bottom bracket 57. This bracket has two vertical portions 57*a* that fit into the bottom of the post 51. These are secured to the post using the same bolts and hardware that are used to secure the slab edge-mount bracket 55. Note that the bottom bracket 57 also has a base 57*b* that has a formed front with ledges 57*c*. These ledges are used to support the glass infill panels, thus eliminating the need for a bottom rail that runs between the posts. Note too, that screws 76 are also used to secure the bottom bracket 57 to the post 51.

Figure 18:
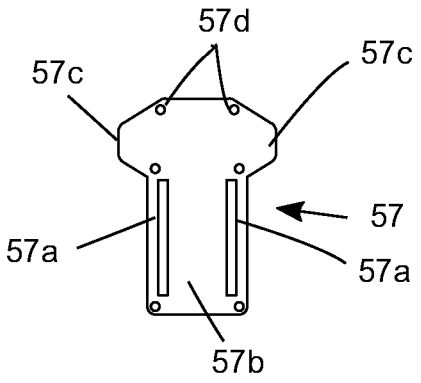
FIG. 18 is a top detail view of a base plate for the second embodiment.

FIG. 18 is a top detail view of a bottom bracket 57 is shown. Note the vertical portions 57*a*, and the base 57*b* that has a formed front with ledges 57*c*. Note too, the screw holes 57*d* that hold the screws 76.

Figure 19:
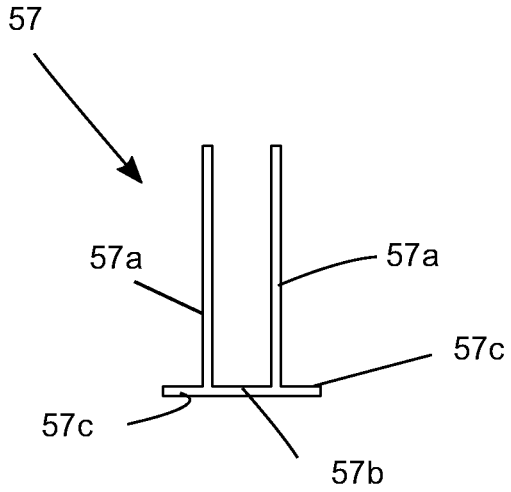
FIG. 19 is a front view of a base plate for the second embodiment.

FIG. 19 is a front view of the bottom bracket 57. Here the vertical portions 57*a*, and the base 57*b* are shown with the ledges 57*c*.

Figure 20:
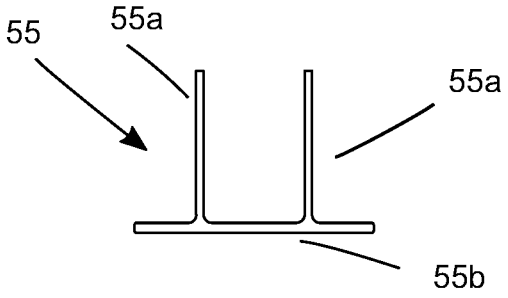
FIG. 20 is a top view of a fascia bracket for the second embodiment.

FIG. 20 is a top view of a slab edge-mount bracket 55. Note the slab edge-mount bracket has two front arms 55*a* that fit around the post 51 and a base plate 55*b* that is secured to the slab face, as discussed above.

Figure 21:
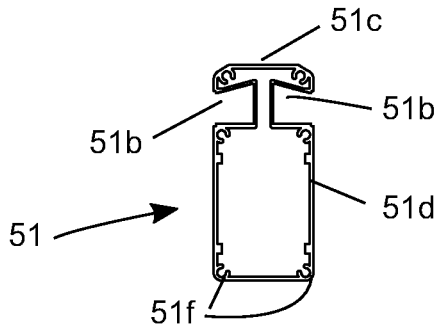
FIG. 21 is a detail view of a post extrusion for the second embodiment.

FIG. 21 is a detail view of a post extrusion 51. There is a rectangular portion 51*d* and a face portion 51*e* with the spaces between them forming the channels 51*b*. Note the screw holes 11*f* that hold the screws 36 that help hold the bottom bracket to the post.

Figure 22:
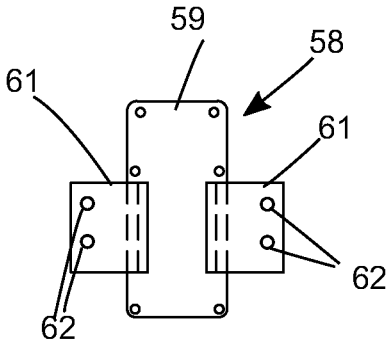
FIG. 22 is a top detail view of a top cap for the second embodiment.

FIG. 22 is a top detail view of a top cap 58 for the second embodiment. The top cap 58 has a base plate 59 that is fastened to the top of the post as discussed above. A pair of angle brackets 61 extends upwards from the baseplate 59 as shown. The tops of the angle brackets lie in the horizontal and are fitted with holes 62 for fasteners 63 that are used to fasten the top rail 52 to the angle brackets 61.

Figure 23:
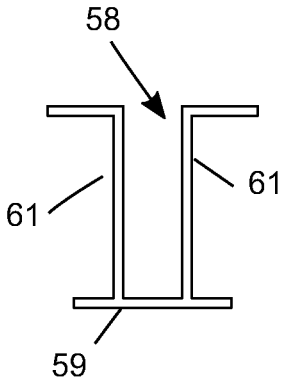
FIG. 23 is a front detail view of the top rail adapter for the second embodiment.
Figure 24:
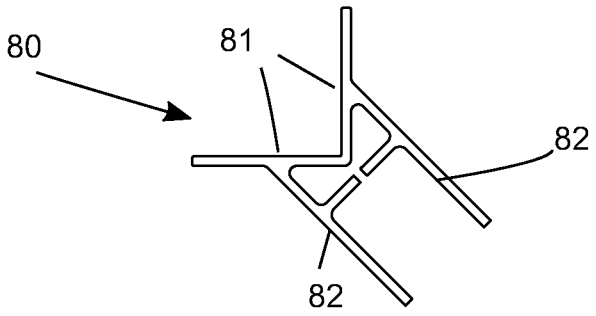
FIG. 24 a top view of a corner fascia bracket for the second embodiment.

FIG. 23 is a front detail view of the top cap 58 for the second embodiment. Again, the pair of angle brackets 61 extends upwards from the baseplate 59 as shown As in the first embodiment, the system also provides brackets for fitting around corners. FIG. 24 is a top view of a corner fascia bracket 80. This bracket has a 90° angle plate 81 and a pair of arms 82 that extend out from the 90° angle plate 81. These arms secure a post to the corner fascia bracket 80, as in the manner discussed above for a straight post section. Note that the corner fascia bracket 80 is attached to the slab with bolts through the 90° angle plate 81, also as discussed above.

Figure 25:
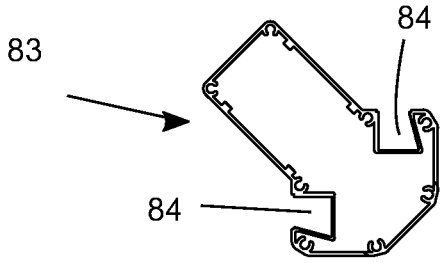
FIG. 25 is a top detail view of a corner post extrusion for the second embodiment.

FIG. 25 is a top detail view of a corner post extrusion 83. Here, the main difference is that the channels 84 that receive the infill panels 53 are set at an angle, so that they form a right angle corner. Each of the infill panels placed in a corner post 80 extend to meet regular posts 51.

The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof.

I claim:

1. A fascia mounted railing system, comprising:

a) a slab, having a front face;

b) at least two posts, spaced apart, each of said at least two posts having a top, a bottom, a bottom portion, two sides, a back and a front, and further wherein the front of each of said at least two posts has a pair of channels to receive at least one infill panel;

c) a mounting bracket assembly, attached to the bottom portion of each of said at least two posts and to said slab to secure each of said at least two posts to said slab;

d) a bottom bracket, attached to the bottom of each of said at least two posts, each of said bottom brackets having a pair of flanges that extend outwardly from the sides of said bottom bracket; and e) the at least one infill panel, placed in one of said channels in each of said at least two posts such that said at least one infill panel sits on one of said pair of flanges on said bottom bracket of each of said at least two posts.

2. The fascia mounted railing system of claim 1 further comprising:

a) a back rail; and b) a bracket, secured to the back of each of said at least two posts, for suspending said back rail from said posts.

3. The fascia mounted railing system of claim 1 further comprising:

(a) a top rail; and (b) a bracket, secured to the top of each of said at least two posts, for supporting said top rail atop each of said at least two posts.

4. The fascia mounted railing system of claim 1 further comprising:

a) at least one corner post spaced apart from said at least two posts, said corner post having a top, a bottom, a bottom portion, two sides, a back and a front, and further wherein the front of said at least one corner post having a pair of channels to receive the at least one infill panel;

b) a mounting bracket assembly, attached to the bottom portion of said at least one corner post and to said slab to secure said at least one corner post to said slab;

c) a bottom bracket, attached to the bottom of said at least one corner post, said bottom bracket having a pair of flanges that extends outwardly from the sides of said bottom bracket; and d) the at least one infill panel, placed in one of said channels in each of said at least two posts such that said at least one infill panel sits on one of said pair of flanges on said bottom bracket of each of said at least two posts.

5. The fascia mounted railing system of claim 4 wherein said pair of channels of said at least one corner post are positioned at an angle of less than 180 degrees with respect to said at least one corner post.

6. The fascia mounted railing system of claim 1 wherein the at least one infill panel has a lower portion and further wherein the lower portion of each at least one infill panel has a ceramic frit pattern applied.

7. The fascia mounted railing system of claim 1 wherein the mounting bracket assembly comprises:

a) a track embedded on the front face of said slab;

b) a pair of fasteners, placed in said track such that said pair of fasteners extends forward from the face of the slab adjacent to one of said at least two posts; and c) a slab edge-mount bracket, secured to each of said at least two posts.

8. The fascia mounted railing system of claim 7 wherein the pair of fasteners comprise a pair of bolts.

9. The fascia mounted railing system of claim 7 wherein the slab edge mount bracket is secured to each of said at least two posts with a set of fasteners.

10. The fascia mounted railing system of claim 9 wherein the set of fasteners comprise:

a) a plurality of bolts, positioned in a plurality of holes formed in said slab edge-mount bracket, b) a washer placed over each of said plurality of bolts;

c) a nut, placed over each of said plurality of bolts; and d) a cap, positioned over each of said nuts.

11. The fascia mounted railing system of claim 1, further comprising:

a) a back rail;

b) a mounting bracket, having a top mount to attach said back rail to said mounting bracket;

c) a post mounting spacer that extends downward from said mounting bracket;

d) a mounting cylinder that is attached to said post mounting spacer; and e) a fastener for securing said mounting cylinder to one of said at least two posts.

12. The fascia mounted railing system of claim 1 further comprising:

a) a top rail; and b) a top cap, for each of said at least two posts, said top cap having a base plate and a pair of angle brackets extending upwards from said baseplate, each of said pair of angle brackets having flanges to fasten said top rail to said angle brackets, and further wherein said base plate of said top cap is attached to the top of one of said at least two posts.

* * * * *